US007416711B2

(12) United States Patent
Liu et al.

(10) Patent No.: US 7,416,711 B2
(45) Date of Patent: Aug. 26, 2008

(54) ATMOSPHERIC PRESSURE LEACH PROCESS FOR LATERITIC NICKEL ORE

(75) Inventors: Houyuan Liu, Shortland (AU); James D. Gillaspie, Yellowknife (AU); Coralie Adele Lewis, Black Hill (AU); David Neudorf, Oakville (CA); Steven Barnett, Hendra (AU)

(73) Assignee: QNI Technology Pty. Ltd., Queensland (AU)

( * ) Notice: Subject to any disclaimer, the term of this patent is extended or adjusted under 35 U.S.C. 154(b) by 709 days.

(21) Appl. No.: 10/513,092

(22) PCT Filed: Mar. 14, 2003

(86) PCT No.: PCT/AU03/00309

§ 371 (c)(1),
(2), (4) Date: May 11, 2005

(87) PCT Pub. No.: WO03/093517

PCT Pub. Date: Nov. 13, 2003

(65) Prior Publication Data

US 2005/0226797 A1 Oct. 13, 2005

(30) Foreign Application Priority Data

Apr. 29, 2002 (AU) ..... PS2019

(51) Int. Cl.
*C23B 23/00* (2006.01)

(52) U.S. Cl. ..... 423/140; 423/150.1; 423/143; 423/150.4

(58) Field of Classification Search ..... 423/150.4, 423/150.1, 140–143
See application file for complete search history.

(56) References Cited

U.S. PATENT DOCUMENTS

| | | | | |
|---|---|---|---|---|
| 3,809,549 | A * | 5/1974 | Opratko et al. | 423/140 |
| 4,062,924 | A | 12/1977 | Glaum et al. | |
| 4,065,542 | A * | 12/1977 | Subramanian et al. | 423/35 |
| 4,415,542 | A * | 11/1983 | Queneau et al. | 423/141 |
| 4,431,613 | A | 2/1984 | Verbaan et al. | |
| 4,515,696 | A * | 5/1985 | Matthew et al. | 210/713 |
| 4,548,794 | A | 10/1985 | Lowenhaupt et al. | |
| 6,039,790 | A | 3/2000 | Hultholm et al. | |
| 6,261,527 | B1 | 7/2001 | Arroyo et al. | |
| 6,379,636 | B2 * | 4/2002 | Arroyo et al. | 423/141 |
| 2002/0006370 | A1 | 1/2002 | Arroyo et al. | |

FOREIGN PATENT DOCUMENTS

| | | |
|---|---|---|
| WO | WO 01/32943 A2 | 5/2001 |
| WO | WO 01/32944 A1 | 5/2001 |

* cited by examiner

*Primary Examiner*—Steven Bos
(74) *Attorney, Agent, or Firm*—B. Aaron Schulman; Stites & Harbison PLLC

(57) ABSTRACT

An atmospheric leach process in the recovery of nickel and cobalt from lateritic ores, said processing including the steps of: a) separating the lateritic ore into a low magnesium containing ore fraction, and a high magnesium containing ore fraction by selective mining or post mining classification; b) separately slurrying the separated ore fractions; c) leaching the low magnesium containing ore fraction with concentrated sulphuric acid as a primary leach step; and d) introducing the high magnesium content ore slurry following substantial completion of the primary leach step and precipitating iron as goethite or another low sulphate containing form of iron oxide or iron hydroxide, wherein sulphuric acid released during iron precipitation is used to leach the high magnesium ore fraction as a secondary leach step.

24 Claims, 4 Drawing Sheets

ATMOSPHERIC PRESSURE LEACH PROCESS FOR LATERITIC NICKEL ORE

The present invention resides in a process for the atmospheric pressure acid leaching of laterite ores to recover nickel and cobalt products.

More specifically the invention resides in the sequential and joint acid leaching of laterite ore fractions to recover nickel and cobalt and discard the iron residue material, substantially free of the iron rich jarosite solid, eg $NaFe_3(SO_4)_2(OH)_6$. In a preferred form, the process of recovery of nickel and cobalt involves the sequential reactions of first, leaching the low magnesium containing ore fractions such as limonite, with sulphuric acid at atmospheric pressure and temperatures up to the boiling point, sequentially followed by the leaching of the high magnesium containing ore fractions such as saprolite. The leached solids contain iron precipitated during leaching, preferably in the goethite form, eg FeOOH, or other relatively low sulphate-containing forms of iron oxide or iron hydroxide, and substantially free of the jarosite form.

The process can also be applied to highly smectitic or nontronitic ores, which typically have iron and magnesium contents between those of typical limonite and saprolite ores. These ores usually leach easily at atmospheric pressure conditions.

BACKGROUND OF THE INVENTION

Laterite ores are oxidised ores and their exploitation requires essentially whole ore processing as generally there is no effective method to beneficiate the ore to concentrate the valuable metals nickel and cobalt.

As shown in Table 1, the iron/nickel ratio is variable being high in the limonite fraction and lower in the saprolite fraction, therefore the separation of solubilized nickel and cobalt from dissolved iron is a key issue in any recovery process.

TABLE 1

Iron, Nickel and Cobalt Content in Various Laterite Ore Sample

| Ore Type | Fe wt. % | Mg wt. % | Ni wt. % | Co wt. % | Fe/Ni ratio |
|---|---|---|---|---|---|
| Indonesia limonite | 40.8 | 1.30 | 1.53 | 0.10 | 27 |
| Indonesia saprolite | 8.5 | 14.60 | 3.37 | 0.03 | 3 |
| Indonesia saprolite with high Fe content | 18.5 | 11.10 | 2.18 | 0.14 | 9 |
| New Caledonia limonite | 47.1 | 0.40 | 1.33 | 0.16 | 35 |
| New Caledonia saprolite | 7.7 | 23.3 | 1.00 | 0.02 | 8 |
| Western Australian low-Mg ore | 25.4 | 4.90 | 2.50 | 0.07 | 10 |
| Western Australian high-Mg ore | 10.0 | 16.6 | 1.38 | 0.02 | 7 |
| Cuban low-Mg nontronite ore | 21.6 | 2.60 | 1.80 | 0.05 | 12 |
| Cuban high-Mg nontronite ore | 18.8 | 8.30 | 1.17 | 0.04 | 16 |

In the acid leaching of lateritic ore, the high pressure acid leaching (HPAL) process was developed to dissolve nickel and cobalt and convert the major portion of solubilized iron to insoluble hematite. This was achieved in autoclaves operated at high temperatures (250-300° C.) and associated pressures. HPAL methods recover high percentages of nickel and cobalt but require expensive, sophisticated equipment to withstand the high pressure and temperature operating conditions.

In order to avoid the use of expensive equipment, alternatives to the HPAL process have been disclosed. These generally operate at temperatures up to 110° C. at atmospheric pressure. One such disclosure is U.S. Pat. No. 6,261,527, which describes the sequential leaching of limonite and saprolite fractions of laterite ore with sulphuric acid at atmospheric pressure and temperatures below the boiling point, discarding most of the dissolved iron as insoluble jarosite solids.

There are environmental concerns with this iron removal process as the jarosite compounds are thermodynamically unstable. Jarosite may decompose slowly to iron hydroxides releasing sulphuric acid. The released acid may redissolve traces of precipitated heavy metals, such as Mn, Ni, Co, Cu and Zn, present in the leach residue tailing, thereby mobilizing these metals into the ground or surface water around the tailings deposit.

Another disadvantage of this process is that jarosite contains sulphate, and this increases the acid requirement for leaching significantly. Sulphuric acid is usually the single most expensive input in acid leaching processing, so there is also an economic disadvantage in the jarosite process.

U.S. Pat. No. 6,379,637 in the name of Walter Curlook describes an atmospheric acid leach process for leaching nickel and cobalt from highly serpentinized saprolitic fractions of nickel laterite ores. This process involves the leaching of the highly serpentinized saprolitic ore by the direct addition of sulphuric acid solutions to the ore at atmospheric pressure. The acid consumption in this process is suggested to be 800 to 1000 kg per tonne of dry ore.

UK Patent GB 2086872 in the name of Falconbridge Nickel Mines Ltd, relates to an atmospheric leaching process of lateritic nickel ores whereby nickel and cobalt are solubilized from high-magnesia nickelferous serpentine ores by leaching the ore with an aqueous solution of sulphuric acid. A reducing agent is also added to the solution in large quantities to maintain the redox potential of the solution at a value of between 200 and 400 mV measured against the saturated calomel electrode.

Such processes utilize direct addition of acid in the leaching process where acid is used to leach the whole content of the ore being processed. With sulphuric acid being an expensive input in the acid leaching process there are economic as well as environment disadvantages to such processes.

The present invention aims to overcome or alleviate one or more of the problems associated with prior art processes.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention as it existed in Australia before the priority date of each claim of this application.

DESCRIPTION OF THE INVENTION

The present invention resides in a process for the atmospheric acid leaching of lateritic ores to recover nickel and cobalt products. In particular, the present invention resides in the acid leaching of separate fractions of the latertic ore sequentially and jointly to recover nickel and cobalt at atmospheric pressure and temperatures up to the boiling point of the acid.

In one embodiment, the present invention resides in an atmospheric leach process in the recovery of nickel and cobalt from lateritic ores, said processing including the steps of:

a) separating the lateritic ore into a low magnesium containing ore fraction, and a high magnesium containing ore fraction by selective mining or post mining classification;

b) separately slurrying the separated ore fractions;

c) leaching the low magnesium containing ore fraction with concentrated sulphuric acid as a primary leach step; and d) introducing the high magnesium content ore slurry following substantial completion of the primary leach step and precipitating iron as goethite or another low sulphate containing form of iron oxide or iron hydroxide, wherein sulphuric acid released during iron precipitation is used to leach the high magnesium ore fraction as a secondary leach step.

The present invention provides an atmospheric pressure leach wherein most of the iron is discarded as solid goethite, or another relatively low sulphate-containing form of iron oxide or iron hydroxide, which contain little or no sulphate moieties, and avoids the disadvantage of precipitating the iron as jarosite. The general reaction is expressed in reaction (1):

$$\underset{\text{Ni-Containing goethite}}{(Fe, Ni)O{\bullet}OH} + \underset{\text{Saprolite}}{(Mg, Ni,)_2Si_2O_5(OH)_4} + H_2SO_4 \quad \underset{\text{Goethite}}{FeO{\bullet}OH} + NiSO_4 + MgSO_4 + SiO_2 + H_2O \tag{1}$$

This general reaction is a combination of the primary limonite leach step and the secondary saprolite leach step.

In the removal of iron as jarosite from the reaction mixture, one mole of acid is produced per mole of iron precipitated. However, when the iron is precipitated as goethite, 1.5 mole of acid is produced per mole of iron precipitated. This is shown in the reactions (2) and (3) below.

The removal of iron as jarosite from the reaction mixture is according to the following reaction:

$$0.5Na_2SO_4 + 1.5Fe_2(SO_4)_3 + 6H_2O \longrightarrow \underset{\text{jarosite}}{NaFe_3(SO_4)_2(OH)_6} + 3H_2SO_4. \tag{2}$$

The removal of iron as goethite from the reaction mixture is according to the following reaction:

$$0.5Fe_2(SO_4)_3 + 2H_2O \longrightarrow \underset{\text{geothite}}{FeO(OH)} + 1.5H_2SO_4, \tag{3}$$

From these reactions, it is demonstrated that removal of iron as jarosite from the reaction mixture results in the loss of 0.5 mole of $H_2SO_4$ per mole of iron compared to the removal of iron as, for example, in the goethite form.

At the critical stage of saprolite leaching, when this loss occurs, less acid remains for the recovery of nickel and cobalt from the saprolite fraction being processed. Therefore, the present invention resides in an improvement on the prior art with respect to the nature and quality of solids discharged and more effective use of the sulphuric acid leachate, which provides economical and environmental advantages.

During the second leach step, the iron is most preferably precipitated as goethite, that is FeO(OH), which results in a higher level of acid being available for the secondary leach step than if the iron was precipitated as, for example, jarosite. A particular feature of the process of the present invention is that as sulphuric acid is released during iron precipitation of the secondary leach step, there is, in general, no need for additional sulphuric acid to be added during this step.

The low magnesium containing ore fraction includes the limonite fraction of the laterite ore (Mg wt % approximately less than 6). This fraction may also include low to medium level magnesium content smectite or nontronite ores which generally have a magnesium content of about 4 wt. % to 8 wt. %. The high magnesium containing ore fraction includes the saprolite fraction of the laterite ore (Mg wt % greater than approximately 8). This fraction may also include smectite or nontronite ores. The slurrying of both the low magnesium and high magnesium containing ore fractions is generally carried out in sodium, alkali metal and ammonium free water at solids concentration from approximately 20 wt % and above, limited by slurry rheology.

The primary leach step is carried out with low-Mg ore for example low magnesium containing limonite ore slurry or low to medium-Mg containing smectite or nontronite ore slurry, and concentrated sulphuric acid at a temperature up to 105° C. or the boiling point of the leach reactants at atmospheric pressure. Most preferably the reaction temperature is as high as possible to achieve rapid leaching at atmospheric pressure. The nickel containing mineral in limonite ore is goethite, and the nickel is distributed in the goethite matrix. The acidity of the primary leach step therefore should be sufficient to destroy the goethite matrix to liberate the nickel. The dose of sulphuric acid is preferably 100 to 140% of the stoichiometric amount to dissolve approximately over 90% of nickel, cobalt, iron, manganese and over 80% of the aluminium and magnesium in the ore.

The ratio of the high magnesium ore, for example saprolite, and the low magnesium ore, for example limonite, is ideally in a dry ratio range of from about 0.5 to 1.3. The saprolite/limonite ratio largely depends on the ore composition. Theoretically, the amount of saprolite added during the secondary leach step should approximately equal the sum of the residual free acid in the primary leach step, and the acid released from the iron precipitation as goethite. Generally about 20-30 g/L of residual free acid remains from the primary leach step while 210-260 g/L sulphuric acid (equivalent to 80-100 g/L $Fe^{3+}$) is released during goethite precipitation.

In order to liberate the cobalt content of asbolane, or other similar Mn (III or IV) minerals, a reductant, eg sulphur dioxide gas or sodium-free metabisulphite or sulphite, is injected into the low magnesium containing ore slurry to control the redox potential to preferably less than 1000 mV (SHE), preferably between 800 and 1000 mV (SHE), and most preferably about 835 mV (SHE) for the primary leach step. At about 835 mV (SHE), cobalt is almost completely released from the asbolane while almost no ferric ion ($Fe^{3+}$) is reduced to the ferrous ion ($Fe^{2+}$)

During the secondary leach step the redox potential is preferably controlled to be between 700 and 900 mV (SHE), most preferably about 720 and 800 mV (SHE). The preferred redox potential in the secondary leach step is slightly less than that of the primary leach step because saprolite contains ferrous ion and the release of ferrous ions decreases the redox potential in the secondary leach step. Therefore, generally no reductant is needed to control the redox potential in this stage of the process. The need for a reductant during the secondary leach step is largely dependant on the content of the saprolite ore and some reductant may be required if, for example, there is a high content of cobalt in asbolane or some oxidant, such as dichromate is present during the saprolite leach.

The completion of reduction and leaching following the secondary leach step is indicated by the formation of 0.5 to 1.0 g/L ferrous ion ($Fe^{2+}$) and steady acid concentration under these reaction conditions. The weight loss of low magnesium ore is typically over 80% and the extraction of nickel and cobalt is over 90%.

The secondary-stage of leaching includes the simultaneous leaching of the high-Mg ore such as saprolite, and iron precipitation, preferably as goethite or other relatively low sulphate-containing forms of iron oxide or iron hydroxide.

The high-Mg ore, eg saprolite slurry, (which may optionally be preheated) and which may also include or consist of medium to high magnesium content nontronite or smectite ore, is added to the reaction mix after the completion of the primary leaching step. The reaction is carried out at the temperature preferably up to 105° C. or the boiling point of the leach reactants at atmospheric pressure. The reaction temperature is most preferably as high as possible to achieve rapid leaching and iron precipitation kinetics. The secondary leach step is generally carried out in a separate reactor from that of the primary leach step.

The dose of high magnesium ore is determined by the free acid remaining from the primary-stage of leaching, the acid released during iron precipitation as goethite and the unit stoichiometric acid-consumption of high-Mg ore at given extractions of nickel, cobalt, iron, magnesium, aluminium and manganese in the ore.

Immediately after the introduction of the high magnesium ore, "seeds" that dominantly contain goethite, hematite or gypsum are preferably added to the reactor, allowing the leaching of high magnesium ore and the iron precipitation as goethite, or other relatively low sulphate-containing form of iron oxide or iron hydroxide, to occur simultaneously.

Simultaneous saprolite leaching and the precipitation of goethite or other relatively low sulphate-containing forms of iron oxide or iron hydroxide, is surprising because, whereas jarosite will form at an acidity range of approximately 5 to 30 g/L free sulphuric acid, goethite will only form at an acidity range of approximately 0 to 10 g/L free sulphuric acid. This is because the hydrolysis pH of goethite is higher than that of jarosite (appropriate pH 3.0 for goethite versus approximate pH 1.5 for natrojarosite at room temperature and unit activities of all species other than protons). It would be expected that little saprolite leaching would occur at such low acidity but the current invention shows that this is not the case.

The dose of seeds is typically 0-20 wt % of the sum of low-Mg ore and high-Mg ore weight. The addition of seed is to either initiate or control the rate of iron precipitation. After the addition of the high magnesium ore, the acidity of the leach slurry firstly drops to approximately 0 g/L $H_2SO_4$, then rebounds to a level of 1-10 g/L $H_2SO_4$. The iron concentration is sharply reduced from 80-90 g/L to less than 40 g/L within 3 hours, then slowly decreases to the equilibrium level of 5-40 g/L. In parallel, the dissolution of nickel and cobalt increases. This indicates that the acid released from the iron precipitation is used as a lixiviant to leach the high-Mg ore, for example, saprolite. The total reaction time is typically 10-12 hours.

The present invention also resides in the recovery of nickel and cobalt following the leaching stage. The leach solution, which may still contain a proportion of the ore iron content as ferric iron after the second leach step, can be prepared for nickel recovery by a number of means, which include the following. Firstly, neutralisation with limestone slurry to force iron precipitation as goethite substantially to completion may be employed, as shown in the examples that follow. The end point of neutralisation is pH 1.5 to 3.0, as measured at ambient temperature. The final pregnant leachate typically contains 2-5 g/L $H_2SO_4$ and 0-6 g/L total iron, including 0.5-1 g/L ferrous ion. A simplified flowsheet for this process option is shown in FIG. 1.

Secondly excess ferric iron remaining in solution at the end of the secondary leaching stage can be precipitated as jarosite by adding a jarosite-forming ion, eg $Na^+$, $K^+$, $NH_4^+$, and jarosite seed material to the leach slurry. In this case, the additional acid liberated during jarosite precipitation can be used to leach additional high-Mg ore. The flowsheet for this option is shown in FIG. 2.

Thirdly, excess ferric iron can be reduced to the ferrous state with a reductant such as sulphur dioxide, as shown in the following reaction:

$$Fe_2(SO_4)_3+SO_2+2H_2O=2FeSO_4+2H_2SO_4 \quad (4)$$

Reaction (4) also generates additional sulphuric acid that can be used to leach additional high magnesium ore. The flowsheet for this process is shown in FIG. 3. Nickel and cobalt can be recovered from the resulting solution by, for example, sulphide precipitation using hydrogen sulphide or other sulphide source. Ferrous iron will not interfere with this process and will not contaminate the sulphide precipitate. Alternatively mixed hydroxide precipitation, ion exchange or liquid-liquid extraction can be used to separate the nickel and cobalt from the ferrous iron and other impurities in the leach solution.

It will be clear to those skilled in the art that other process options for completing the separation of nickel and cobalt from iron in solution may be employed.

EXAMPLES

Comparative Example 1

For purpose of comparison this test simulated the conditions claimed in U.S. Pat. No. 6,261,527 to leach nickel and cobalt from laterite ore and precipitate iron as jarosite. The weight ratio of saprolite and limonite for this test was 0.90. The weight ratio of sulfuric acid to limonite ore was 1.43. Therefore the weight ratio of sulfuric acid to ore (limonite and saprolite) was 0.75. In this test 190 grams limonite ore and 171 grams saprolite ore with high iron content (Fe>10 wt %) were mixed with synthetic seawater to form 20 wt % and 25 wt % solids slurry, respectively. The limonite slurry was mixed with 277 g 98 wt % sulphuric acid in a reactor at the temperature of 95 to 105° C. and atmospheric pressure for 140 minutes. The leachate contained 18 g/L $H_2SO_4$, 3.1 g/L Ni, 88 g/L Fe, 1.8 g/L Mg and 0.22 g/L Co. The redox potential was controlled between 870 to 910 mV (SHE) by adding sodium metabisulphite. After the acidity stabilised around 20 g/L $H_2SO_4$ the saprolite slurry and 80 grams jarosite containing seeds were consecutively added into the reactor. The total reaction time was 10 hours. The leachate contained 20 g/L $H_2SO_4$, 4.3 g/L Ni, 2.0 g/L Fe, 15.7 g/L Mg and 0.30 g/L Co. Finally 32 grams limestone in 25 wt % slurry was added to the reactor at 95 to 105° C. to neutralise the acidity from 23 g/L to pH 1.8. The final leachate contained 2 g/L $H_2SO_4$, 4.3 g/L Ni, 0.2 g/L Fe, 15.9 g/L Mg and 0.30 g/L Co. The weight of leaching residue was 508 grams. Table 2 illustrates the feed and residue composition and the leaching extractions. The results were similar to the results reported in Example 3 of U.S. Pat. No. 6,261,527. The existence of natro (sodium) jarosite in leaching residue was verified by the sodium content and the XRD pattern of the residue (see Table 2 and FIG. 4).

TABLE 2

| Results of Example 1 | Ni | Fe | Mg | Co | Na |
|---|---|---|---|---|---|
| Limonite, wt % | 1.49 | 40.1 | 1.64 | 0.150 | <0.01 |
| Saprolite, wt % | 1.89 | 13.8 | 14.65 | 0.140 | 0.16 |
| Seeds, wt % | 0.12 | 29.4 | 0.58 | <0.005 | 0.65 |
| Residue, wt % | 0.23 | 25.9 | 0.84 | 0.013 | 1.83 |
| Overall Extraction, % | 81.1 | 0 | 85.1 | 85.0 | |

Example 2

The low magnesium laterite ore (Mg wt %<6), eg limonite slurry and high-Mg (Mg wt %>8) laterite ore eg saprolite slurry, were separately prepared with potable water. The iron content of the saprolite ore used was 18 wt %. The solid concentrations of limonite and saprolite slurry were 20 wt % and 25 wt % respectively. The weight ratios of sulfuric acid/limonite, saprolite/limonite and sulfuric acid/ore (limonite and saprolite) were 1.36, 0.88 and 0.72 respectively. In this test 934 grams 20 wt % limonite slurry was mixed with 267 grams 98 wt % $H_2SO_4$ in a reactor at the temperature of 95 to 105° C. and atmospheric pressure for 2.5 hours. The leachate contained 23 g/L $H_2SO_4$, 3.0 g/L Ni, 84 g/L Fe, 1.9 g/L Mg and 0.24 g/L Co. The redox potential was controlled between 835 to 840 mV (SHE) by adding sodium-free sulphite. After the acidity was stabilised around 26 g/L $H_2SO_4$, 673 grams 25 wt % saprolite slurry and 80 grams of goethite containing seeds were consecutively added into the reactor. The reaction of saprolite leaching and iron precipitation was carried out at 95 to 105° C. and atmospheric pressure for 10 hours. The redox potential was 720 to 800 mV (SHE) without adding the sodium-free sulphite. The leachate contained 8 g/L $H_2SO_4$, 3.6 g/L Ni, 20.6 g/L Fe, 14.3 g/L Mg and 0.34 g/L Co. Finally 69 grams limestone in 25 wt % slurry was added into the reactor at 95 to 105° C. and atmospheric pressure to neutralise the acidity to pH 1.7. The final leachate contained 9 g/L $H_2SO_4$, 3.9 g/L Ni, 4.7 g/L Fe including 3.0 g/L $Fe^{+2}$, 15.0 g/L Mg and 0.33 g/L Co. The weight of leaching residue was 384 grams. Table 3 illustrates the feed and residue composition and the leaching extractions. The iron precipitation into leaching residue as goethite was verified by the undetectable sodium content and XRD/SEM examination of the residue (see Table 3 and FIG. 4).

TABLE 3

| Results of Example 2 | Ni | Fe | Mg | Co | Na |
|---|---|---|---|---|---|
| Limonite, wt % | 1.55 | 40.8 | 1.47 | 0.12 | <0.01 |
| Saprolite, wt % | 2.17 | 18.0 | 11.6 | 0.14 | <0.01 |
| Seeds, wt % | 0.41 | 27.9 | 1.17 | 0.068 | <0.01 |
| Residue, wt % | 0.35 | 28.7 | 0.96 | 0.007 | <0.01 |
| Overall Extraction, % | 80.8 | 6.5 | 82.0 | 94.9 | |

Example 3

In this test the weight ratios of sulfuric acid/limonite, saprolite/limonite and sulfuric acid/ore (limonite and saprolite) were 1.37, 0.69 and 0.81 respectively. 935 grams 20 wt % limonite slurry described in Example 2 was mixed with 267 grams 98 wt % $H_2SO_4$ in a reactor at the temperature of 95 to 105° C. and atmospheric pressure for 3 hours. The leachate contained 24 g/L $H_2SO_4$, 2.8 g/L Ni, 77 g/L Fe, 1.9 g/L Mg and 0.21 g/L Co. The redox potential was controlled between 835 to 840 mV (SHE) by adding sodium-free sulphite. After the acidity stabilised around 26 g/L $H_2SO_4$, 524 grams 25 wt % saprolite slurry described in Example 2 and 80 grams goethite containing seeds were consecutively added into the reactor. The reaction of saprolite leaching and iron precipitation was carried out at 95 to 105° C. and atmospheric pressure for 10 hours. The redox potential was 720 to 800 mV (SHE) without adding the sodium-free sulphite. The leachate containing 3 g/L $H_2SO_4$, 3.5 g/L Ni, 27.4 g/L Fe, 12.2 g/L Mg and 0.30 g/L Co. Finally 95 grams limestone in 25 wt % slurry was added into a reactor at 95 to 105° C. and atmospheric pressure to neutralise the acidity to pH 1.7. The final leachate contained 3 g/L $H_2SO_4$, 3.6 g/L Ni, 4.2 g/L Fe including 1.7 g/L $Fe^{+2}$, 13.1 g/L Mg and 0.32 g/L Co. The weight of leaching residue was 402 grams. Table 4 illustrates the feed and residue composition and the leaching extractions. The iron precipitation into leaching residue as goethite was verified by the undetectable sodium content and XRD/SEM examination of the residue (see Table 4 and FIG. 4).

TABLE 4

| Results of Example 3 | Ni | Fe | Mg | Co | Na |
|---|---|---|---|---|---|
| Limonite, wt % | 1.53 | 40.3 | 1.46 | 0.110 | <0.01 |
| Saprolite, wt % | 2.18 | 18.4 | 12.40 | 0.140 | <0.01 |
| Seeds, wt % | 0.41 | 26.7 | 1.27 | 0.074 | <0.01 |
| Residue, wt % | 0.27 | 23.8 | 0.96 | 0.006 | <0.01 |
| Overall Extraction, % | 82.2 | 5.5 | 80.8 | 94.7 | |

Example 4

In this test the weight ratios of sulfuric acid/limonite, saprolite/limonite and sulfuric acid/ore (limonite and saprolite) were 1.37, 0.58 and 0.87 respectively. 935 grams 20 wt % limonite slurry described in Example 2 was mixed with 267 grams 98 wt % $H_2SO_4$ in a reactor at the temperature of 95 to 105° C. and atmospheric pressure for 3 hours. The leachate contained 24 g/L $H_2SO_4$, 3.3 g/L Ni, 92 g/L Fe, 2.1 g/L Mg and 0.24 g/L Co. The redox potential was controlled between 840 to 850 mV (SHE) by adding sodium-free sulphite. After the acidity stabilised around 25 g/L $H_2SO_4$, 440 grams 25 wt % saprolite slurry described in Example 2 and 80 grams goethite containing seeds were consecutively added into the reactor. The reaction of saprolite leaching and iron precipitation was carried out at 95 to 105° C. and atmospheric pressure for 11 hours. The redox potential was 800 to 840 mV (SHE) without adding the sodium-free sulphite. The leachate contained 4 g/L $H_2SO_4$, 3.5 g/L Ni, 35.1 g/L Fe, 11.4 g/L Mg and 0.31 g/L Co. Finally, 93 grams limestone in 25 wt % slurry was added into a reactor at 95 to 105° C. and atmospheric pressure to neutralise the acidity to pH 1.4. The final leachate contained 5 g/L $H_2SO_4$, 3.6 g/L Ni, 5.8 g/L Fe including 0.8 g/L $Fe^{+2}$, 12.1 g/L Mg and 0.32 g/L Co. The weight of leaching residue was 368 grams. The iron precipitation into leaching residue as goethite was verified by the undetectable sodium content and XRD/SEM examination of the residue ctable sodium content and XRD/SEM examination of the residue (see Table 5 and FIG. 4).

TABLE 5

| Results of Example 4 | Ni | Fe | Mg | Co | Na |
|---|---|---|---|---|---|
| Limonite, wt % | 1.48 | 39.6 | 1.41 | 0.110 | <0.01 |
| Saprolite, wt % | 2.20 | 18.5 | 11.30 | 0.140 | <0.01 |
| Seeds, wt % | 0.43 | 28.6 | 1.16 | 0.072 | <0.01 |
| Residue, wt % | 0.24 | 24.5 | 0.85 | 0.007 | <0.01 |
| Overall Extraction, % | 84.2 | 7.5 | 80.5 | 93.9 | |

Example 5

The low magnesium laterite ore slurry (Mg wt %<6), eg limonite slurry and high-Mg (Mg wt %>8) laterite ore slurry eg saprolite slurry, were separately prepared with potable water. The iron content of saprolite was 9 wt %. The solid concentrations of limonite and saprolite slurry were 21 wt % and 25 wt % respectively. In this test 817 grams limonite slurry was mixed with 233 grams 98 wt % $H_2SO_4$ in a reactor at the temperature of 95 to 105° C. and atmospheric pressure for 2.5 hours. The leachate contained 21 g/L $H_2SO_4$, 3.0 g/L Ni, 84 g/L Fe, 2.0 g/L Mg and 0.22 g/L Co. The redox potential was controlled between 835 to 840 mV (SHE) by adding sodium-free sulphite. After the acidity was stabilised around 20 g/L $H_2SO_4$, 849 grams saprolite slurry and 40 grams of goethite containing seeds were consecutively added into the reactor. The weight ratio of sulfuric acid/limonite, Saprolite/limonite and sulfuric acid/(limonite+saprolite) for this test was 1.32, 1.25 and 0.59. The reaction of saprolite leaching and iron precipitation was carried out at 95 to 105° C. and atmospheric pressure for 10 hours. The redox potential was 720 to 800 mV (SHE) without adding the sodium free sulphite. The leachate contained 7 g/L $H_2SO_4$, 5.5 g/L Ni, 5.9 g/L Fe, 18.9 g/L Mg and 0.14 g/L Co. Finally 23 grams limestone in 25 wt % slurry was added into the reactor at 95 to 105° C. and atmospheric pressure to neutralise the acidity to pH 1.8. The final leachate contained 2.5 g/L $H_2SO_4$, 5.5 g/L Ni, 5.9 g/L Fe including 3.7 g/L $Fe^{+2}$, 19.4 g/L Mg and 0.14 g/L Co. The weight of leaching residue was 319 grams. Table 6 illustrates the feed and residue composition and the leaching extractions.

TABLE 6

| Results of Example 5 | Ni | Fe | Mg | Co | Na |
|---|---|---|---|---|---|
| Limonite, wt % | 1.59 | 41.4 | 1.45 | 0.12 | <0.01 |
| Saprolite, wt % | 3.43 | 8.46 | 15.2 | 0.034 | <0.01 |
| Seeds, wt % | 0.37 | 23.8 | 1.30 | 0.006 | <0.01 |
| Residue, wt % | 0.56 | 26.1 | 1.94 | 0.008 | <0.01 |
| Overall Extraction, % | 82.7 | 16.4 | 82.8 | 91.0 | |

Example 6

The low magnesium laterite ore slurry (Mg wt %<6), eg limonite slurry and high-Mg (Mg wt %>8) laterite ore slurry eg saprolite slurry, were separately prepared with potable water. The iron content of saprolite was 9 wt %. The solid concentrations of limonite and saprolite slurry were 21 wt % and 25 wt % respectively. In this test 1050 grams limonite slurry was mixed with 300 grams 98 wt % $H_2SO_4$ in a reactor at the temperature of 95 to 105° C. and atmospheric pressure for 2.5 hours. The leachate contained 23 g/L $H_2SO_4$, 3.0 g/L Ni, 83 g/L Fe, 2.0 g/L Mg and 0.22 g/L Co. The redox potential was controlled between 835 to 840 mV (SHE) by adding sodium-free sulphite. After the acidity was stabilised around 23 g/L $H_2SO_4$, 546 grams saprolite slurry and 40 grams of goethite containing seeds were consecutively added into the reactor. The weight ratio of sulfuric acid/limonite, saprolite/limonite and sulfuric acid/(limonite+saprolite) for this test was 1.32, 0.61 and 0.82. The reaction of saprolite leaching and iron precipitation was carried out at 95 to 105° C. and atmospheric pressure for 10 hours. The redox potential was 720 to 800 mV (SHE) without adding the sodium-free sulphite. The leachate contained 7 g/L $H_2SO_4$, 5.3 g/L Ni, 24.8 g/L Fe, 17.0 g/L Mg and 0.18 g/L Co. Finally 90 grams limestone in 25 wt % slurry was added into the reactor at 95 to 105° C. and atmospheric pressure to neutralise the acidity to pH 1.7. The final leachate contained 2 g/L $H_2SO_4$, 5.8 g/L Ni, 4.3 g/L Fe including 3.3 g/L $Fe^{+2}$, 18.8 g/L Mg and 0.20 g/L Co. The weight of leaching residue was 413 grams. Table 7 illustrates the feed and residue composition and the leaching extractions.

TABLE 7

| Results of Example 6 | Ni | Fe | Mg | Co | Na |
|---|---|---|---|---|---|
| Limonite, wt % | 1.53 | 40.3 | 1.46 | 0.110 | <0.01 |
| Saprolite, wt % | 3.43 | 8.7 | 15.2 | 0.032 | <0.01 |
| Seeds, wt % | 0.37 | 23.8 | 1.30 | 0.006 | <0.01 |
| Residue, wt % | 0.21 | 23.6 | 0.67 | <0.005 | <0.01 |
| Overall Extraction, % | 89.5 | 12.5 | 88.6 | >95 | |

Example 7

The low magnesium laterite ore slurry (Mg wt %<6), eg limonite slurry and high-Mg (Mg wt %>8) laterite ore slurry eg saprolite slurry, were separately prepared with potable water. The iron content of saprolite was 11 wt %. The solid concentrations of limonite and saprolite slurry were 20 wt % and 25 wt % respectively. In this test 1001 grams limonite slurry was mixed with 286 grams 98 wt % $H_2SO_4$ in a reactor at the temperature of 95 to 105° C. and atmospheric pressure for 2.5 hours. The leachate contained 28 g/L $H_2SO_4$, 2.6 g/L Ni, 74 g/L Fe, 1.9 g/L Mg and 0.20 g/L Co. The redox potential was controlled between 835 to 840 mV (SHE) by adding sodium-free sulphite. After the acidity was stabilised around 28 g/L $H_2SO_4$, 720 grams saprolite slurry and 40 grams of goethite containing seeds were consecutively added into the reactor. The weight ratio of sulfuric acid/limonite, saprolite/limonite and sulfuric acid/(limonite+saprolite) for this test was 1.40, 0.90 and 0.74. The reaction of saprolite leaching and iron precipitation was carried out at 95 to 105° C. and atmospheric pressure for 10 hours. The redox potential was 720 to 800 mV (SHE) without adding the sodium-free sulphite. The leachate contained 11 g/L $H_2SO_4$, 4.3 g/L Ni, 14.8 g/L Fe, 16.6 g/L Mg and 0.16 g/L Co. Finally 80 grams limestone in 25 wt % slurry was added into the reactor at 95 to 105° C. and atmospheric pressure to neutralise the acidity to pH 1.7. The final leachate contained 1.7 g/L $H_2SO_4$, 4.3 g/L Ni, 2.1 g/L Fe, 17.3 g/L Mg and 0.16 g/L Co. The weight of leaching residue was 381 grams. Table 8 illustrates the feed and residue composition and the leaching extractions.

TABLE 8

| Results of Example 7 | Ni | Fe | Mg | Co | Na |
|---|---|---|---|---|---|
| Limonite, wt % | 1.57 | 42.3 | 1.40 | 0.120 | <0.01 |
| Saprolite, wt % | 2.73 | 11.4 | 14.4 | 0.041 | <0.01 |
| Seeds, wt % | 0.37 | 23.8 | 1.30 | 0.006 | <0.01 |
| Residue, wt % | 0.30 | 25.5 | 1.21 | <0.005 | <0.01 |
| Overall Extraction, % | 86.1 | 15.5 | 84.3 | >95 | |

Example 8

This test simulated the process shown on FIG. 2. The weight ratio of sulfuric acid/limonite, Saprolite/limonite and sulfuric acid/(limonite+saprolite) for this test was 1.31, 1.19 and 0.60. 817 grams 21 wt % limonite slurry described in Example 2 was mixed with 233 grams 98 wt % $H_2SO_4$ in a reactor at the temperature of 95 to 105° C. and atmospheric pressure for 3 hours. The leachate contained 20 g/L $H_2SO_4$, 3.2 g/L Ni, 87 g/L Fe, 2.1 g/L Mg and 0.24 g/L Co. The redox potential was controlled between 835 to 840 mV (SHE) by adding sodium-free sulphite. After the acidity stabilised around 20 g/L $H_2SO_4$, 828 grams 25 wt % saprolite slurry described in Example 2 and 80 grams goethite containing seeds were consecutively added into the reactor. The reaction of saprolite leaching and iron precipitation was carried out at 95 to 105° C. and atmospheric pressure for 3 hours. The leachate contained 3.4 g/L $H_2SO_4$, 3.3 g/L Ni, 18.3 g/L Fe, 12.8 g/L Mg and 0.32 g/L Co. Then 12 g NaCl as sea salt was added into slurry to precipitate the residual iron as jarosite for another 6 hours. The leachate containing 11 g/L $H_2SO_4$, 3.7 g/L Ni, 1.4 g/L Fe, 17.3 g/L Mg and 0.32 g/L Co. The redox potential of saprolite leach was 720 to 800 mV (SHE) without adding the sodium-free sulphite. Finally 15.5 grams limestone in 25 wt % slurry was added into a reactor at 95 to 105° C. and atmospheric pressure to neutralise the acidity to pH 1.6. The final leachate contained 4 g/L $H_2SO_4$, 3.9 g/L Ni, 0.6 g/L Fe including 0.5 g/L $Fe^{+2}$, 17.8 g/L Mg and 0.32 g/L Co. The weight of leaching residue was 403 grams. Table 9 illustrates the feed and residue composition and the leaching extractions.

TABLE 9

| Results of Example 8 | Ni | Fe | Mg | Co | Na |
|---|---|---|---|---|---|
| Limonite, wt % | 1.53 | 40.3 | 1.46 | 0.110 | <0.01 |
| Saprolite, wt % | 2.18 | 18.4 | 12.40 | 0.140 | <0.01 |
| Seeds, wt % | 0.27 | 22.9 | 1.11 | 0.074 | <0.01 |
| Residue, wt % | 0.4 | 28.1 | 1.12 | 0.005 | <0.01 |
| Overall Extraction, % | 78.4 | 10.7 | 83.1 | 95.9 | |

Example 9

This test simulated the process shown in FIG. 3. The weight ratio of sulfuric acid/limonite, Saprolite/limonite and sulfuric acid/(limonite+saprolite) for this test was 1.32, 1.20 and 0.60. 817 grams 21 wt % limonite slurry described in Example 2 was mixed with 233 grams 98 wt % $H_2SO_4$ in a reactor at the temperature of 95 to 105° C. and atmospheric pressure for 3 hours. The leachate contained 20 g/L $H_2SO_4$, 3.1 g/L Ni, 82 g/L Fe, 2.1 g/L Mg and 0.23 g/L Co. The redox potential was controlled between 840 to 850 mV (SHE) by adding sodium-free sulphite. After the acidity stabilised around 20 g/L $H_2SO_4$, 828 grams 25 wt % saprolite slurry described in Example 2 and 80 grams goethite containing seeds were consecutively added into the reactor. The reaction of saprolite leaching and iron precipitation as goethite was carried out at 95 to 105° C. and atmospheric pressure for 3 hours. The leachate contained 3.4 g/L $H_2SO_4$, 3.5 g/L Ni, 19.8 g/L Fe, 13.4 g/L Mg and 0.32 g/L Co. The redox potential was 780 to 840 mV (SHE) without adding the sodium-free sulphite. Then $SO_2$ gas was sparged into slurry for 8 hours. The redox potential was decreased to 590 to 620 mV (SHE). The leachate contained 14 g/L $H_2SO_4$, 4.2 g/L Ni, 27.7 g/L Fe including 25.2 g/L $Fe^{+2}$, 18.3 g/L Mg and 0.32 g/L Co. Finally, 42 grams limestone in 25 wt % slurry was added into a reactor at 95 to 105° C. and atmospheric pressure to neutralise the acidity to pH 1.8. The final leachate contained 2 g/L $H_2SO_4$, 4.1 g/L Ni, 25 g/L Fe including 24.4 g/L $Fe^{+2}$, 18 g/L Mg and 0.31 g/L Co. The conversion from $Fe^{+3}$ to $Fe^{+2}$ closed 100%. The weight of leaching residue was 332 grams. Table 10 illustrates the feed and residue composition and the leaching extractions.

TABLE 10

| Results of Example 9 | Ni | Fe | Mg | Co | Na |
|---|---|---|---|---|---|
| Limonite, wt % | 1.57 | 41.2 | 1.45 | 0.120 | <0.01 |
| Saprolite, wt % | 2.26 | 19.0 | 11.30 | 0.140 | <0.01 |
| Seeds, wt % | 0.28 | 26.1 | 1.04 | 0.007 | <0.01 |
| Residue, wt % | 0.45 | 26.4 | 1.46 | 0.009 | <0.01 |
| Overall Extraction, % | 80.4 | 33.4 | 81.9 | 94.2 | |

Example 10—Pilot Plant Operation

In a 96-hour pilot plant operation 2972 kilograms 20 wt % limonite slurry and 825 kilograms 98 wt % $H_2SO_4$ were continuously pumped into a series of Complete Stirred Tank Reactors (CSTR) at the temperature of 95° to 105° C. and atmospheric pressure. The redox potential was controlled between 835 to 940 mV (SHE) by sparging $SO_2$ gas. The retention time of limonite leach was 4 hours. The leachate contained 29 g/L $H_2SO_4$, 2.4 g/L Ni, 70 g/L Fe, 1.9 g/L Mg and 0.13 g/L Co. The limonite leaching slurry was mixed with the saprolite slurry with the solid concentration of 25 wt % in another series of CSTR at 95 to 105° C. and atmospheric pressure for the simultaneous reactions of saprolite leaching and iron precipitation as goethite. The retention time of saprolite leach and iron precipitation as goethite was 10 hours. There was no $SO_2$—sparge in this section. The total weight of 25 wt % saprolite slurry used was 1978 kilograms. Therefore the weight ratios of sulfuric acid/Limonite, Saprolite/Limonite and sulfuric acid/(limonite+saprolite) were 1.36, 0.83 and 0.74 respectively. The leachate containing 5 g/L $H_2SO_4$, 3.6 g/L Ni, 18.6 g/L Fe, 14.1 g/L Mg and 0.15 g/L Co. The leaching slurry was consecutively neutralized at 95° to 105° C. and atmospheric pressure to pH 1.5-2.0 or the acidity of 5-10 g/L $H_2SO_4$ with 20 wt % limestone slurry. The retention time was 2-3 hours. The total weight of limestone slurry was 884 kg. The final leachate contained 5 g/L $H_2SO_4$, 3.0 g/L Ni, 3.5 g/L Fe including 0.2 g/L $Fe^{+2}$, 12.1 g/L Mg and 0.13 g/L Co. Table 11 illustrates the feed and residue composition and the leaching extractions.

TABLE 11

| | Results of Example 10 | | | | |
|---|---|---|---|---|---|
| | Ni | Fe | Mg | Co | Na |
| Limonite, wt % | 1.54 | 41.5 | 1.38 | 0.114 | 0.06 |
| Saprolite, wt % | 2.72 | 11.31 | 14.33 | 0.040 | 0.03 |
| Residue, wt % | 0.33 | 21.8 | 1.22 | <0.005 | 0.06 |
| Overall Extraction, % | 80.8 | 2.83 | 80.6 | >95 | |

Example 11—Pilot Plant Operation

In a 89-hour pilot plant operation 2538 kilograms 30 wt % limonite slurry and 1052 kilograms 98 wt % $H_2SO_4$ were continuously pumped into a series of Complete Stirred Tank Reactors (CSTR) at the temperature of 95° to 105° C. and atmospheric pressure. The redox potential was controlled between 835 to 940 mV (SHE) by sparging $SO_2$ gas. The retention time of limonite leach was 5 hours. The leachate of limonite leaching section contained 20 g/L $H_2SO_4$, 4.8 g/L Ni, 136 g/L Fe, 3.2 g/L Mg and 0.25 g/L Co. The limonite leaching slurry was mixed with saprolite slurry with the solid concentration of 30 wt % in another series of CSTR at 95° to 105° C. and atmospheric pressure for the simultaneous reactions of saprolite leaching and iron precipitation as goethite. The retention time of saprolite leach and iron precipitation as goethite was 11 hours. There was no $SO_2$-sparge in this section. The total weight of saprolite slurry used was 2052 kilograms. Therefore the weight ratios of sulfuric acid/Limonite, Saprolite/Limonite and sulfuric acid/(limonite+saprolite) were 1.35, 0.81 and 0.75 respectively. The leachate containing 5 g/L $H_2SO_4$, 5.1 g/L Ni, 6.4 g/L Fe, 16.4 g/L Mg and 0.19 g/L Co. The leaching slurry was consecutively neutralized at 95° to 105° C. and atmospheric pressure to pH 1.5-2.0 or the acidity of 5-10 g/L $H_2SO_4$ with 20 wt % limestone slurry. The retention time was 2-3 hours. The total weight of limestone slurry was 1248 kg. The final leachate contained 5 g/L $H_2SO_4$, 5.1 g/L Ni, 6.4 g/L Fe including 0.2 g/L $Fe^{+2}$, 16.4 g/L Mg and 0.19 g/L Co. Table 12 illustrates the feed and residue composition and the leaching extractions.

TABLE 12

| | Results of Example 11 | | | | |
|---|---|---|---|---|---|
| | Ni | Fe | Mg | Co | Na |
| Limonite, wt % | 1.54 | 42.7 | 1.49 | 0.117 | 0.06 |
| Saprolite, wt % | 3.12 | 10.95 | 13.35 | 0.039 | 0.02 |
| Residue, wt % | 0.35 | 22.02 | 1.58 | 0.006 | 0.05 |
| Overall Extraction, % | 81.5 | 9.3 | 72.7 | 91.6 | |

Figure 1:
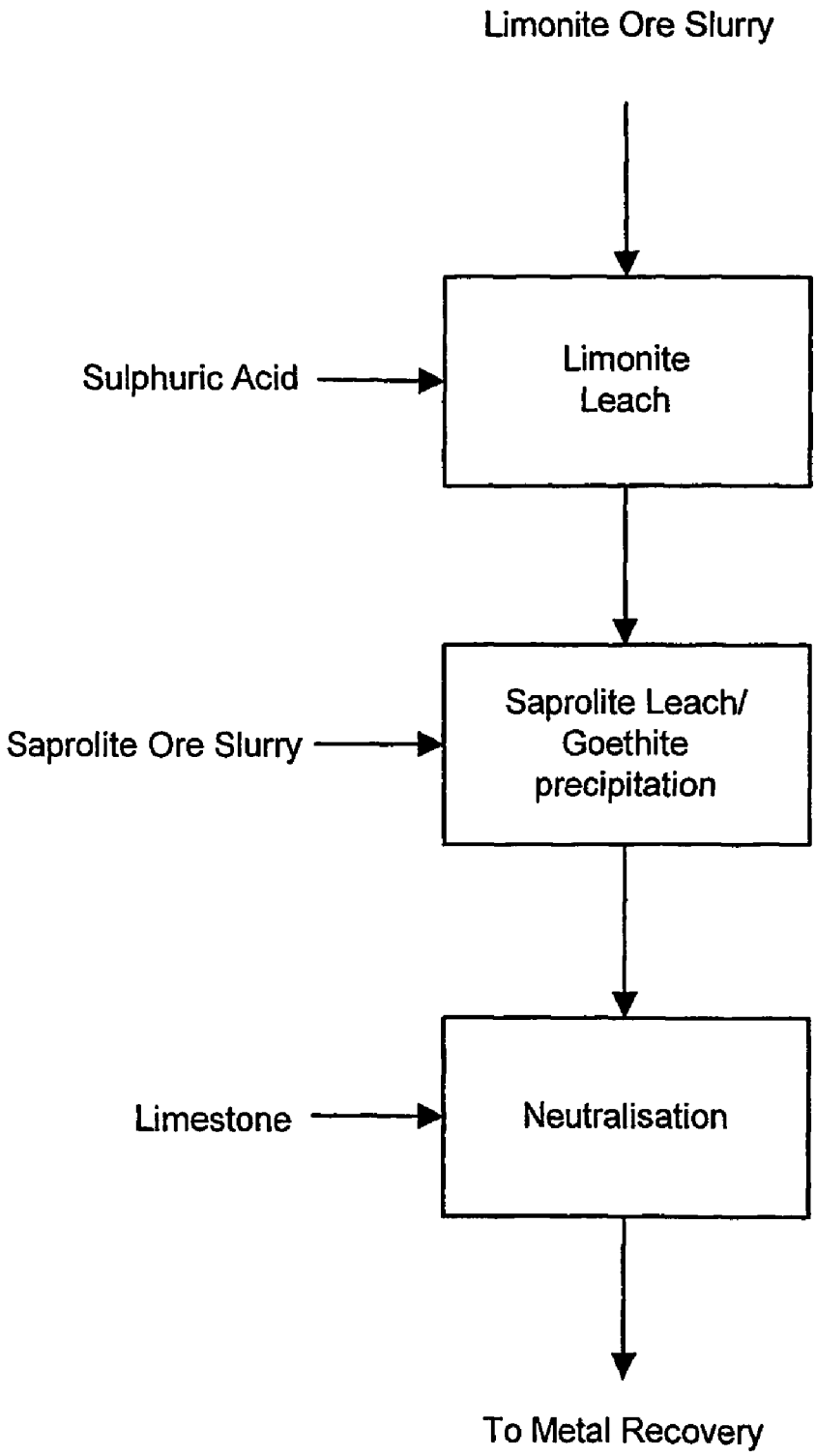
FIG. 1 is a flowsheet showing the introduction of limonite ore slurry and saprolite ore slurry sequentially allowing the elimination of approximately 70% of the solubilized iron as solid goethite during saprolite leaching and most of the remainder by neutralisation with limestone or other suitable alkali.
Figure 2:
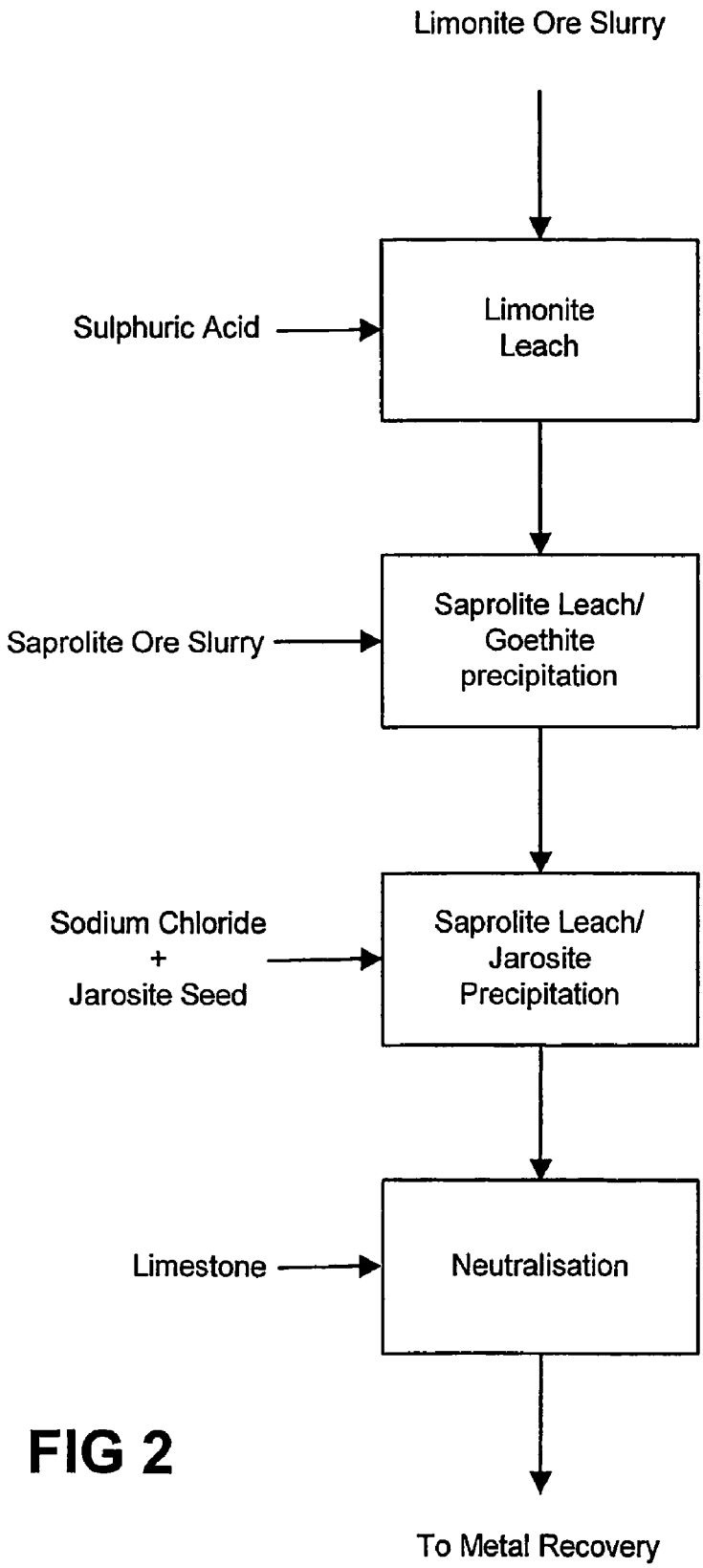
FIG. 2 shows a flowsheet in which, following the simultaneous leaching of saprolite and precipitation of most of the iron as goethite, the remainder of the iron is precipitated as jarosite by the addition of a jarosite-forming ion, for example by sodium chloride addition. Additional saprolite may be leached during this stage.
Figure 3:
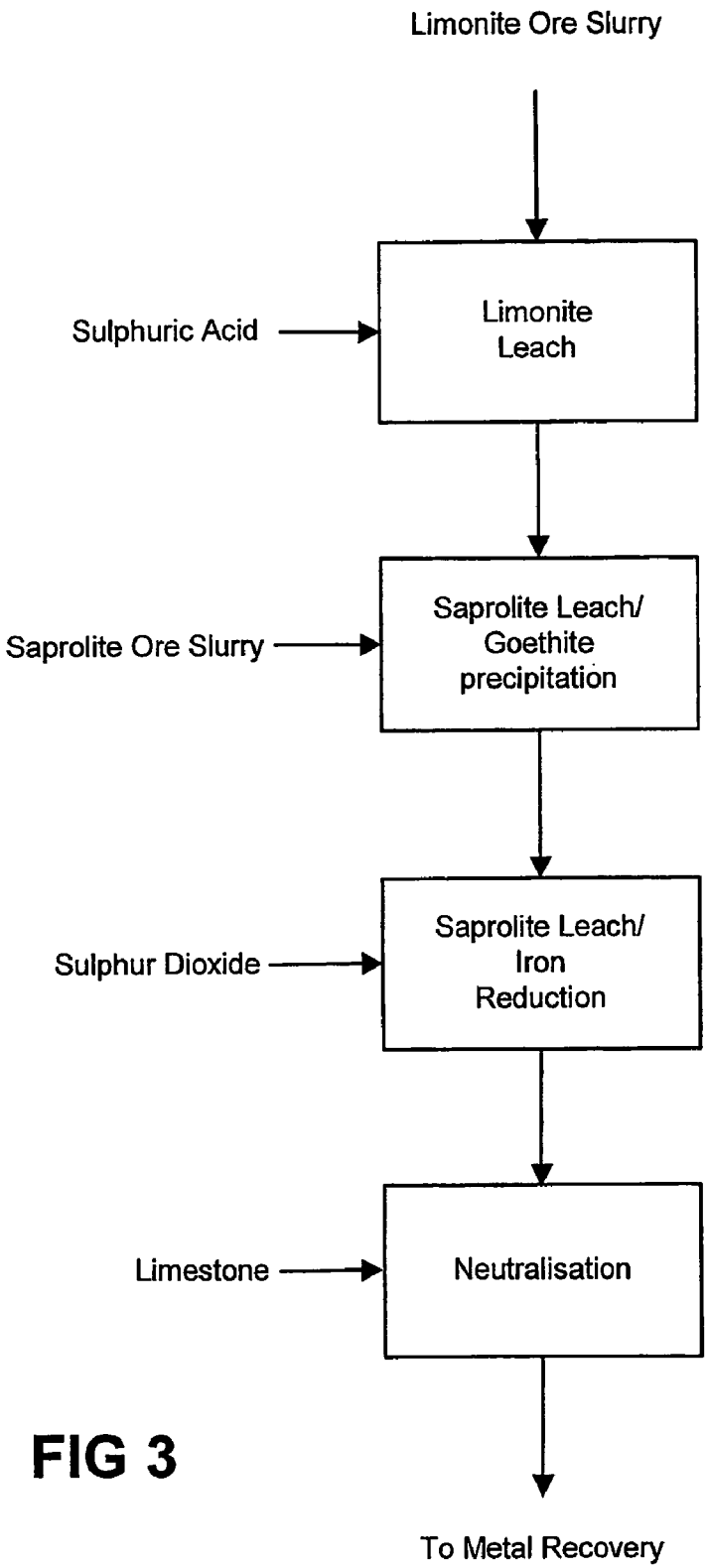
FIG. 3 shows a flowsheet in which, following the simultaneous leaching of saprolite and precipitation of most of the iron as goethite, the remainder of the iron is reduced to the ferrous state by the addition of sulphur dioxide or other suitable reductant. Again, additional saprolite may be leached during this stage.
Figure 4:
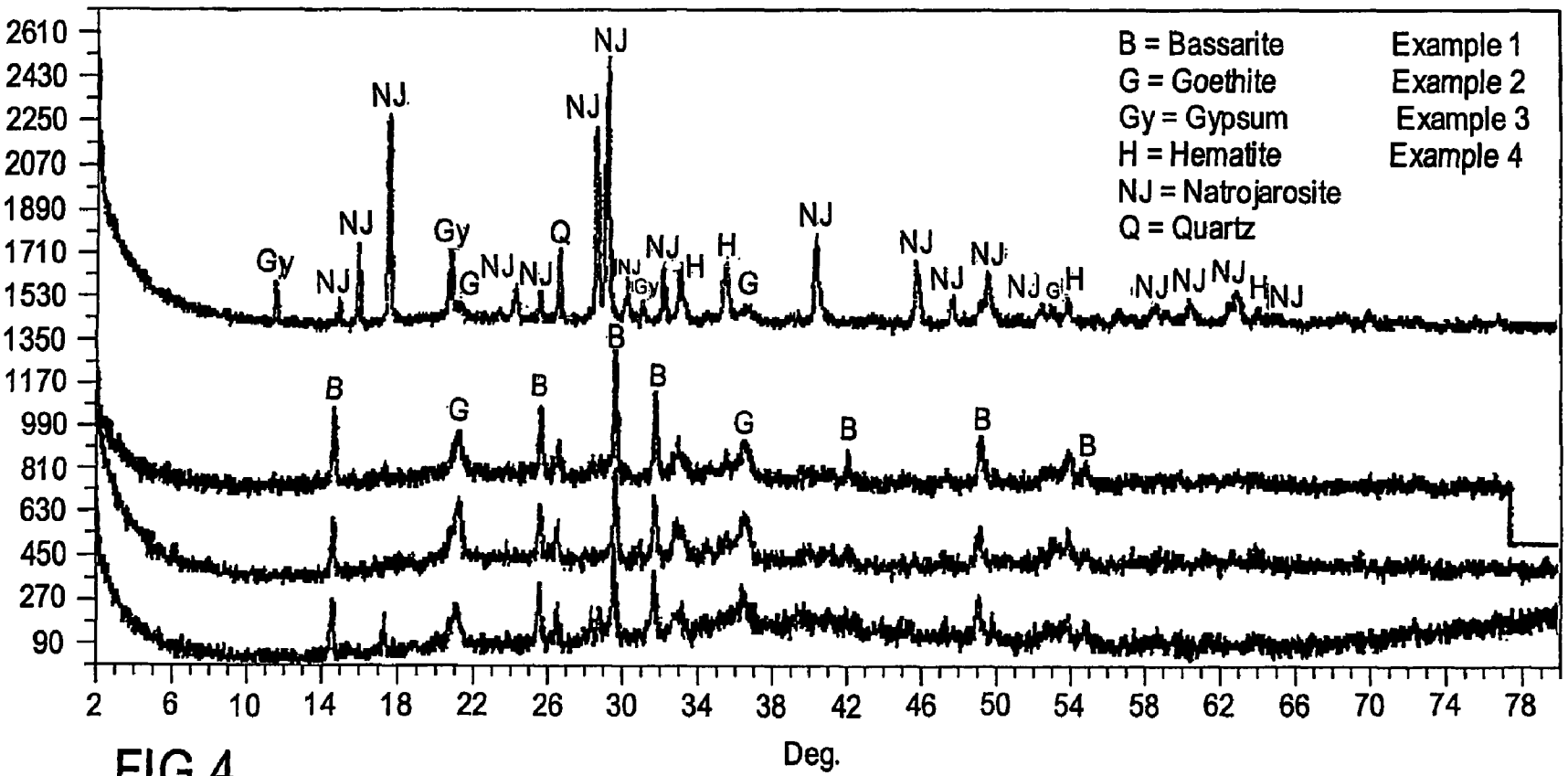
FIG. 4 shows the XRD patterns for the leach residues from comparative Example 1 and Example 2 to 4. The pattern for Comparative Example 1 is at the top of the figure and Example 4 pattern is at the base.

The presence of peaks for goethite and absence of peaks for jarosite are evident in patterns 2, 3 and 4.

The above description of the invention is illustrative of the preferred embodiments of the invention. Variations without departing from the spirit or ambit of the invention described herein are to be considered to form part of the invention.

Claims defining the invention are as follows:

1. An atmospheric leach process in the recovery of nickel and cobalt from lateritic ores, said processing including the steps of: a) separating the lateritic ore into a low magnesium containing ore fraction, and a high magnesium containing ore fraction by selective mining or post mining classification; b) separately slurrying the separated ore fractions; c) leaching the low magnesium containing ore fraction with concentrated sulphuric acid as a primary leach step; and d) introducing the high magnesium content ore slurry following substantial completion of the primary leach step and precipitating iron as goethite or another low sulphate containing form of iron oxide or iron hydroxide, wherein sulphuric acid released during iron precipitation is used to leach the high magnesium ore fraction as a secondary leach step.

2. A process according to claim 1 wherein the iron is precipitated as goethite.

3. A process according to claim 1, wherein the low magnesium containing ore fraction includes limonite ore containing less than about 6 weight % magnesium.

4. A process according to claim 1, wherein the high magnesium containing ore fraction includes saprolite ore having greater than about 8 weight % magnesium.

5. A process according to claim 3, wherein the low magnesium containing ore fraction also includes medium level magnesium content smectite or nontronite ore.

6. A process according to claim 4, wherein the high magnesium containing ore fraction also includes medium level magnesium content smectite or nontronite ore.

7. A process according to claim 1, wherein the separated ore fractions are slurried in sodium, alkali metal and ammonium free water at solids concentration greater than approximately 20 weight %.

8. A process according to claim 1, wherein the primary leach step is carried out in a first reactor at a temperature of up to 105° C. or the boiling point of the leach reactants at atmospheric pressure.

9. A process according to claim 8, wherein the sulphuric acid is preferably in a concentration of from 100 to 140% of stoichiometric proportions.

10. A process according to claim 1 wherein the high magnesium content ore slurry is introduced in a second reactor for completion of the secondary leach step at a temperature of up to 105° C. or boiling point of the leach reactants at atmospheric pressure.

11. A process according to claim 10, wherein goethite, hematite or gypsum containing seeds are added to the second reactor immediately after the introduction of the high magnesium containing ore to initiate or assist iron precipitation.

12. A process according to claim 11, wherein the dose of seeds is added in an amount of up to 20 weight % of the total of the low magnesium containing ore and high magnesium containing ore weight.

13. A process according to claim 1, wherein the redox potential during the primary leach step is controlled to between 800 mV and 1000 mV (SHE).

14. A process according to claim 13 wherein the redox potential in the primary leach step is about 835 mV (SHE).

15. A process according to claim 13, wherein the redox potential is controlled by injecting either sulphur dioxide gas, or sodium-free metabisulphite or sulphite into the slurry.

16. A process according to claim 13 wherein the redox potential in the secondary leach step is between 700 and 900 mV (SHE).

17. A process according to claim 1, wherein the dry ratio between the high magnesium ore and low magnesium ore is from about 0.5 to 1.3.

18. A process according to claim 1, including the further step of neutralisation of the leach solution after the secondary leach step by the addition of a limestone slurry to complete iron precipitation as goethite.

19. A process according to claim 18, wherein the end point of neutralisation is to raise the pH to 1.5 to 3.0 as measured at ambient temperature.

20. A process according to claim 1, including the further step of precipitating the remaining iron after the secondary leach step as jarosite by the addition of a jarosite forming ion.

21. A process according to claim 20, wherein the jarosite forming ion is sodium, potassium or ammonium ion.

22. A process according to claim 1, including the further step of reducing the remaining iron after the secondary leach step, to the ferrous state by the addition of a suitable reductant.

23. A process according to claim 22, wherein the reductant is sulphur dioxide.

24. A process according to claim 1, wherein the nickel and cobalt is recovered by way of either sulphide precipitation using hydrogen sulphide or other sulphide source, mixed hydroxide precipitation, ion exchange or liquid-liquid extraction.

* * * * *